US009548593B2

(12) United States Patent
Kanemaru et al.

(10) Patent No.: US 9,548,593 B2
(45) Date of Patent: Jan. 17, 2017

(54) SPARK PLUG

(71) Applicant: NGK SPARK PLUG CO., LTD., Nagoya-shi, Aichi (JP)

(72) Inventors: Tomonori Kanemaru, Kasugai (JP); Daisuke Sumoyama, Nagoya (JP); Osamu Yoshimoto, Inazawa (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/030,718

(22) PCT Filed: Sep. 2, 2014

(86) PCT No.: PCT/JP2014/004497

§ 371 (c)(1),
(2) Date: Apr. 20, 2016

(87) PCT Pub. No.: WO2015/068326

PCT Pub. Date: May 14, 2015

(65) Prior Publication Data

US 2016/0276811 A1 Sep. 22, 2016

(30) Foreign Application Priority Data

Nov. 8, 2013 (JP) ..... 2013-231754

(51) Int. Cl.
*H01T 13/20* (2006.01)
*H01T 13/39* (2006.01)
*H01T 13/32* (2006.01)

(52) U.S. Cl.
CPC ..... *H01T 13/39* (2013.01); *H01T 13/32* (2013.01)

(58) Field of Classification Search
CPC ..... H01T 13/39; H01T 13/32
See application file for complete search history.

(56) References Cited

U.S. PATENT DOCUMENTS

| | | | | |
|---|---|---|---|---|
| 5,998,913 | A | 12/1999 | Matsutani | 313/141 |
| 2002/0130602 | A1 | 9/2002 | Kanao et al. | 313/141 |
| 2003/0015951 | A1 | 1/2003 | Segawa et al. | 313/141 |
| 2005/0184633 | A1 | 8/2005 | Kato | 313/141 |
| 2006/0043855 | A1 | 3/2006 | Nunome et al. | 313/120 |
| 2006/0061250 | A1 | 3/2006 | Yoshimoto et al. | 313/141 |
| 2010/0264804 | A1 | 10/2010 | Kameda et al. | 313/141 |
| 2013/0099654 | A1* | 4/2013 | Ma | H01T 21/02 313/141 |

FOREIGN PATENT DOCUMENTS

| | | | | |
|---|---|---|---|---|
| CN | 1630151 | A | 6/2005 | H01T 13/32 |
| CN | 1698244 | A | 11/2005 | H01T 13/39 |
| CN | 101868891 | A | 10/2010 | H01T 13/20 |
| EP | 1168542 | A1 | 1/2002 | H01T 13/20 |
| JP | 2003-197347 | A | 7/2003 | H01T 13/20 |
| JP | WO 2004/105204 | A1 | 12/2004 | H01T 13/39 |
| JP | 3672718 | B2 | 7/2005 | C22C 5/04 |
| JP | 4402046 | B2 | 1/2010 | C22C 5/04 |
| JP | 4672551 | B2 | 4/2011 | C22C 5/04 |

OTHER PUBLICATIONS

International Search Report issued in International Patent Application No. PCT/JP2014/004497, dated Oct. 7, 2014.
Office Action received in corresponding Chinese Patent Application No. 201480061141.2, dated Sep. 26, 2016.

* cited by examiner

*Primary Examiner* — Donald Raleigh
(74) *Attorney, Agent, or Firm* — Kusner & Jaffe

(57) ABSTRACT

A spark plug having a tip provided on at least one of a center electrode and a ground electrode. The spark plug includes a center electrode and a ground electrode disposed providing a gap with the center electrode. At least one of the center electrode and the ground electrode includes a tip forming the gap. The tip has a main constituent of Ir. The tip contains Rh of 7 mass % or more to 31 mass % or less, Ru of 5 mass % or more to 20 mass % or less, and Pt of one-twentieth or more to one-half or less of a Ru content.

8 Claims, 3 Drawing Sheets

SPARK PLUG

RELATED APPLICATIONS

This application is a National Stage of International Application No. PCT/JP2014/004497 filed Sep. 2, 2014, which claims the benefit of Japanese Patent Application No. 2013-231754, filed Nov. 8, 2013.

FIELD OF THE INVENTION

This invention relates to a spark plug. This invention especially relates to the spark plug that includes a tip at least provided on one of a center electrode and a ground electrode.

BACKGROUND OF THE INVENTION

A spark plug is used to ignite an internal combustion engine such as a vehicle engine. Generally, the spark plug includes a tubular metal shell, a tubular insulator arranged in an inner hole of this metal shell, a center electrode arranged at the inner hole on a distal end side of the insulator, and a ground electrode whose one end is bonded to the distal end side of the metal shell and the other end includes a spark discharge gap with the center electrode. Further, the spark plug is spark-discharged at the spark discharge gap which is formed between the distal end portion of the center electrode and the distal end portion of the ground electrode, in a combustion chamber of the internal combustion engine to burn a fuel filled up in the combustion chamber.

As a material forming the center electrode and the ground electrode, a Ni alloy or the like is generally used. Regarding oxidation resistance and wear resistance, the Ni alloy is slightly inferior to a precious metal alloy whose main constituent is a precious metal such as Pt and Ir. However, because of its inexpensiveness compared with the precious metal, the Ni alloy is preferably used as the material forming the ground electrode and the center electrode.

Recently, there has been a trend of high-temperature of a temperature in the combustion chamber. Therefore, if spark discharge occurs between the distal end portion of the ground electrode and the distal end portion of the center electrode made of the Ni alloy or the like, each distal end portion of the ground electrode and the center electrode opposed to one another is likely to generate spark erosion. Therefore, there has been developed a method for improving the wear resistances of the ground electrode and the center electrode by disposing tips at each distal end portion of the ground electrode and the center electrode opposed to one another to generate the spark discharge at the tips.

As the material forming the tips, a material whose main constituent is a precious metal excellent in the oxidation resistance and spark erosion resistance is often used. The material includes Ir, an Ir alloy, a Pt alloy, or the like.

For example, Japanese Patent No. 3672718 discloses a spark plug that uses an IR—Rh alloy as a material of a firing end. Specifically, Japanese Patent No. 3672718 discloses the spark plug that includes a precious metal tip "formed from an alloy containing Ir as a main component, Rh in an amount of 0.1 wt. % to 35 wt. %, and at least one of Ru and Re in an amount of 0.1 wt. % to 17 wt. % in total." Objects of this invention are the following two points. An object is to provide a spark plug that shows remarkably less susceptibility to wear of a firing end stemming from oxidation/volatilization of Ir constituent at high temperatures as compared with a conventional Ir—Rh alloy, and can secure excellent durability in traveling in an urban area as well as in high speed driving. The other object is to provide a spark plug that can contain a smaller amount of expensive Rh than that of a conventional one and secure durability with low costs (claim 1 and paragraph 0006 in Japanese Patent No. 3672718).

Japanese Patent No. 4672551 discloses a spark plug that includes the precious metal tip "containing Ir as a main component, 0.5 to 40 mass % of Rh, and 0.5 to 1 mass % of Ni, and further containing at least one of Pt and Pd by 4 to 8 mass %" to provide the spark plug that can suppress sweating and peeling of precious metal in a surface of the discharge portion while suppressing spark erosion, oxidative consumption, and abnormal erosion of the discharge portion (claim 1 and paragraph 0006 in Japanese Patent No. 4672551).

Recently, a spark plug that can support various driving styles has been required. That is, a spark plug having excellent durability under any conditions, such as a condition putting emphasis on an output under low oxygen concentration atmosphere by increasing a mixing ratio of fuel to air and a condition putting emphasis on fuel economy under high oxygen concentration atmosphere by decreasing the mixing ratio of the fuel to the air, has been required.

An evaluation of the conventional tip with such viewpoint found the following problem. The inventors examined a composition of the tip that can reduce the oxidative consumption and found the following. The tip made of an Ir—Rh—Ru alloy containing Ir as a main component, Rh, and Ru was able to reduce the oxidative consumption at an Air/Fuel ratio of around 12 and an inside of a combustion chamber being under the low oxygen concentration atmosphere. However, at the Air/Fuel ratio of around 14 and the inside of the combustion chamber being under the high oxygen concentration atmosphere, which have been conventionally put emphasis on, the oxidative consumption proceeded and sufficient durability was not able to be obtained.

An advantage of this invention is a spark plug including a tip provided on at least one of the center electrode and the ground electrode and featuring good durability by reducing oxidative consumption without an influence from oxygen concentration under an environment of this tip being exposed.

SUMMARY OF THE INVENTION (1) In accordance with a first aspect of the present invention, there is provided a spark plug having a center electrode and a ground electrode disposed providing a gap with the center electrode. At least one of the center electrode and the ground electrode includes a tip forming the gap. The tip has a main constituent of Ir and contains Rh of 7 mass % or more to 31 mass % or less, Ru of 5 mass % or more to 20 mass % or less, and Pt of one-twentieth or more to one-half or less of a Ru content.

(2) In accordance with a second aspect of the present invention, there is provided a spark plug as described above, wherein the tip has a Rh content of 7 mass % or more to 27 mass % or less and a Ru content of 5 mass % or more to 17 mass % or less.

(3) In accordance with a third aspect of the present invention, there is provided a spark plug as described above, wherein the tip has a Rh content of 7 mass % or more to 24 mass % or less and a Ru content of 6 mass % or more to 15 mass % or less.

(4) In accordance with a fourth aspect of the present invention, there is provided a spark plug as described above, wherein the tip has a Rh content of 7 mass % or more to 21 mass % or less, and a Ru content of 6 mass % or more to 13 mass % or less.

(5) In accordance with a fifth aspect of the present invention, there is provided a spark plug according to any one of (1) to (4), wherein the tip further contains Ni of 0.1 mass % or more to 4.5 mass % or less.

(6) In accordance with a sixth aspect of the present invention, there is provided a spark plug according to any one of (1) to (5), wherein an area S when projecting the tip to an imaginary plane parallel to a bonding surface of the center electrode or the ground electrode and the tip is 0.07 $mm^2$ or more.

(7) In accordance with a seventh aspect of the present invention, there is provided a spark plug as described above, wherein the area S is 0.10 $mm^2$ or more.

(8) In accordance with an eighth aspect of the present invention, there is provided a spark plug as described above, wherein the area S is 0.15 $mm^2$ or more.

According to this invention, as the tip provided on at least one of the center electrode and the ground electrode contains Ir as the main constituent, Rh of 7 mass % or more to 31 mass % or less, Ru of 5 mass % or more to 20 mass % or less, and Pt of one-twentieth or more to one-half or less of a Ru content, it is possible to provide a spark plug with good durability and reduce the oxidative consumption without an influence from the oxygen concentration in an environment to which this tip is exposed.

BRIEF DESCRIPTION OF THE DRAWINGS

FIG. 3(*a*) is an explanatory view of the main part when a boundary surface between the tip and the ground electrode remains at their bonded portion. FIG. 3(*b*) is an explanatory view of the main part when a fusion portion is formed at the entire bonded portion of the tip and the ground electrode.

DETAILED DESCRIPTION OF THE PREFERRED EMBODIMENTS

Figure 1:
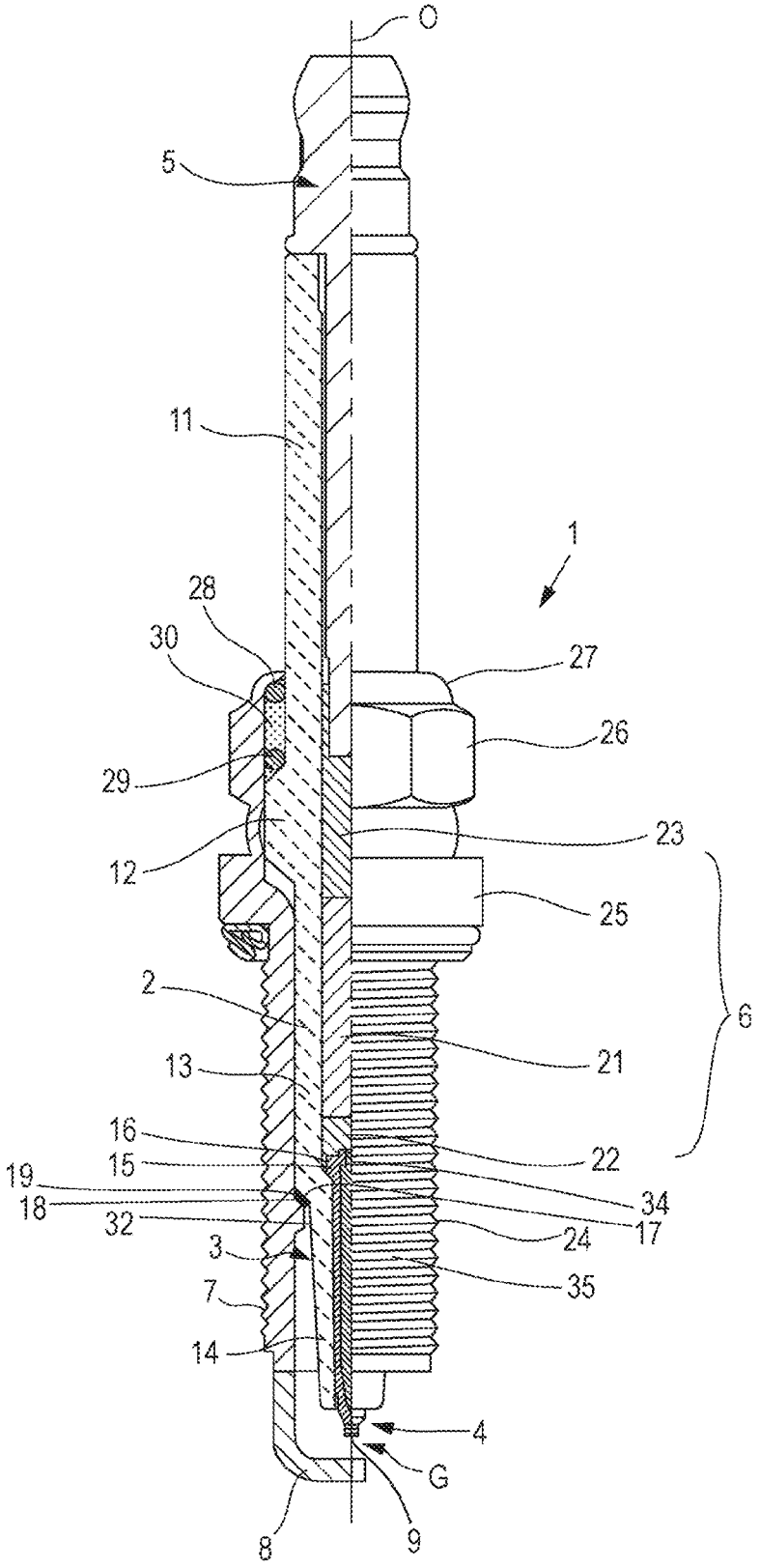
FIG. 1 is a partial cross-sectional overall explanatory view of a spark plug of one embodiment of a spark plug according to this invention.

FIG. 1 shows a spark plug of one embodiment of a spark plug according to this invention. FIG. 1 is a partial cross-sectional overall explanatory view of the spark plug 1 of one embodiment of the spark plug according to this invention. Further, FIG. 1 describes a lower side of the paper, that is, a side where a ground electrode, which will be described later, is disposed as a distal end direction of an axial line O and an upper side of the paper as a rear end direction of the axial line O.

A spark plug 1, as shown in FIG. 1, includes an approximately cylindrical-shaped insulator 3 having an axial hole 2 extending in the axial line O direction, an approximately rod-shaped center electrode 4 disposed at the distal end side in the axial hole 2, a terminal metal fitting 5 disposed at the rear end side in the axial hole 2, a connecting portion 6 electrically connecting the center electrode 4 and the terminal metal fitting 5 in the axial hole 2, an approximately cylindrical-shaped metal shell 7 holding the insulator 3, and a ground electrode 8. The one end portion of the ground electrode 8 is bonded to the distal end portion of the metal shell 7 and the other end portion of the ground electrode 8 is disposed so as to be opposed to the center electrode 4 via a gap G. The center electrode 4 has a tip 9 at the front end surface.

The insulator 3 has the axial hole 2 extending in the axial line O direction and the approximately cylindrical shape. Further, the insulator 3 includes a rear end body portion 11, a large-diameter portion 12, a front end body portion 13, and an insulator nose portion 14. The rear end body portion 11 houses the terminal metal fitting 5 and insulates the terminal metal fitting 5 and the metal shell 7. The large-diameter portion 12 projects radially outward at the distal end side with respect to this rear end body portion. The front end body portion 13 houses the connecting portion 6 at the distal end side of the large-diameter portion 12. The front end body portion 13 has a smaller outer diameter than the large-diameter portion 12. The insulator nose portion 14 houses the center electrode 4 at the distal end side of this front end body portion 13. The insulator nose portion 14 has a smaller outer diameter and internal diameter than the front end body portion 13. Inner peripheral surfaces of the front end body portion 13 and the insulator nose portion 14 are connected via a shelf portion 15. A collar portion 16, which will be described later, of the center electrode 4 is disposed so as to be in contact with this shelf portion 15, securing the center electrode 4 to the inside of the axial hole 2. Outer peripheral surfaces of the front end body portion 13 and the insulator nose portion 14 are connected via a step part 17. A tapered portion 18, which will be described later, of the metal shell 7 is in contact with this step part 17 via a plate packing 19, securing the insulator 3 to the metal shell 7. The insulator 3 is secured to the metal shell 7 with the end portion of the insulator 3 in the distal end direction projected from the front end surface of the metal shell 7. The insulator 3 is preferably made of a material featuring mechanical strength, thermal strength, and electrical strength. As such material, for example, a ceramic sintered material mainly containing alumina can be listed.

The axial hole 2 of the insulator 3 internally includes the center electrode 4 at the distal end side and the terminal metal fitting 5 at the rear end side. Between the center electrode 4 and the terminal metal fitting 5, the connecting portion 6 securing the center electrode 4 and the terminal metal fitting 5 to the inside of the axial hole 2 and electrically connecting the center electrode 4 and the terminal metal fitting 5 is disposed. The connecting portion 6 is formed of a resistor 21 reducing propagation noise, a first seal body 22 disposed between this resistor 21 and the center electrode 4, and a second seal body 23 disposed between this resistor 21 and the terminal metal fitting 5. The resistor 21 is formed by sintering a composition containing glass powder, non-metal conductive powder, metal powder, or the like. A resistance value of the resistor 21 is usually at 100Ω or more. The first seal body 22 and the second seal body 23 are formed by sintering a composition containing the glass powder, the metal powder, or the like. A resistance value of the first seal body 22 and the second seal body 23 is usually 100 mΩ or less. The connecting portion 6 of this embodiment is formed of the resistor 21, the first seal body 22, and the second seal body 23. However, the connecting portion 6 may also be formed of at least one of the resistor 21, the first seal body 22, and the second seal body 23.

The metal shell 7 has the approximately cylindrical shape. The metal shell 7 is formed so as to hold the insulator 3 by internally mounting the insulator 3. A screw portion 24 is formed at the outer peripheral surface of the metal shell 7 in the distal end direction. Using this screw portion 24, the spark plug 1 is mounted to a cylinder head (not shown) of the internal combustion engine. The metal shell 7 has a flange-shaped gas seal portion 25 at the rear end side of the screw portion 24. The metal shell 7 has a tool engagement portion 26 engaging a tool such as a spanner and a wrench at the rear end side of the gas seal portion 25 and a crimping portion 27 at the rear end side of the tool engagement portion 26. At an annular space formed between the inner peripheral surfaces of the crimping portion 27 and the tool engagement portion 26 and the outer peripheral surface of the insulator 3, ring-shaped packings 28 and 29 and a talc 30 are disposed, thus securing the insulator 3 to the metal shell 7. The distal end side of the inner peripheral surface of the screw portion 24 is disposed to have a space to the insulator nose portion 14. The tapered portion 18 radially expanding in a taper shape at the rear end side of a projection portion 32 projecting radially inward and the step part 17 of the insulator 3 are in contact via the annular plate packing 19. The metal shell 7 can be made of a conductive steel material, for example, low-carbon steel.

The terminal metal fitting 5 is a terminal nut to apply a voltage for spark discharge between the center electrode 4 and the ground electrode 8 from the outside to the center electrode 4. The terminal metal fitting 5 is inserted into the axial hole 2 with a part of the terminal metal fitting 5 exposed from the rear end side of the insulator 3 and is secured with the second seal body 23. The terminal metal fitting 5 can be made of a metallic material such as low-carbon steel.

The center electrode 4 has a rear end portion 34 being in contact with the connecting portion 6, and a rod-shaped portion 35 extending from the rear end portion 34 to the distal end side. The rear end portion 34 has the collar portion 16 projecting radially outward. The collar portion 16 is disposed to be in contact with the shelf portion 15 of the insulator 3. Further, between the inner peripheral surface of the axial hole 2 and the outer peripheral surface of the rear end portion 34, the first seal body 22 is filled up. Accordingly, the center electrode 4 is secured to the inside of the axial hole 2 of the insulator 3 with the distal end of the center electrode 4 projecting from the front end surface of the insulator 3, thus insulated and held to the metal shell 7. The rear end portion 34 and the rod-shaped portion 35 in the center electrode 4 can be made of a known material used for the center electrode 4, such as Ni or the Ni alloy whose main constituent is Ni. The center electrode 4 may be formed of an outer layer made of the Ni alloy or the like and a core portion made of a material having thermal conductivity higher than the Ni alloy. The core portion is formed so as to be concentrically embedded into an axial center portion at the inside of this outer layer. As the material forming the core portion, for example, Cu, a Cu alloy, Ag, an Ag alloy, and pure Ni can be listed.

The ground electrode 8 is, for example, formed into an approximately prism shape. The one end portion of the ground electrode 8 is bonded to the distal end portion of the metal shell 7 and is flexed (i.e., bent) into an approximately L shape in mid-course. The other end portion of the ground electrode 8 is formed so as to be opposed to the distal end portion of the center electrode 4 via the gap G. The ground electrode 8 can be made of a known material used for the ground electrode 8, such as Ni or the Ni alloy, or the like. Further, similar to the center electrode 4, at an axis core portion of the ground electrode, the core portion made of the material having higher thermal conductivity than the Ni alloy may be disposed.

The tip 9 has a columnar shape in this embodiment and is disposed at only the center electrode 4. The shape of the tip 9 is not especially limited. As the shape other than the columnar shape, an appropriate shape, such as an elliptic cylinder shape, a prismatic shape, and a plate shape can be employed. Further, the tip 9 may be disposed only at the ground electrode 8, or may be disposed at both the ground electrode 8 and the center electrode 4. In addition, it is only necessary that at least one of the tips, which are disposed at the ground electrode 8 and the center electrode 4, is formed of the tip made of the material having properties, which will be described later. The other tip may be made of the known material used as the tip. The tip 9 is bonded to the center electrode 4 by an appropriate method such as a laser beam welding and a resistance welding.

In this embodiment, the gap G is the shortest distance between the front end surface of the tip 9 disposed at the center electrode 4 and the side surface of the ground electrode 8 opposed to this front end surface. This gap G is usually set to 0.3 to 1.5 mm. Assume the case of a horizontal discharge type spark plug where the side surface of the tip disposed at the center electrode and the tip disposed at the ground electrode are opposed. The shortest distance between the respective opposed surfaces where the side surface of the tip disposed at the center electrode is opposed to the tip disposed at the distal end portion of the ground electrode becomes the gap G. The spark discharge occurs at this gap G.

The following describes the tip, the discriminative part of this invention, in detail.

The main constituent of the tip 9 is Ir. The tip 9 contains Rh of 7 mass % or more to 31 mass % or less, Ru of 5 mass % or more to 20 mass % or less, and Pt of one-twentieth or more to one-half or less of the Ru content. The main constituent of the tip 9 is preferably Ir. The tip 9 preferably contains Rh of 7 mass % or more to 27 mass % or less, Ru of 5 mass % or more to 17 mass % or less, and Pt of one-twentieth or more to one-half or less of the Ru content. The main constituent of the tip 9 is more preferably Ir. The tip 9 more preferably contains Rh of 7 mass % or more to 24 mass % or less, Ru of 6 mass % or more to 15 mass % or less, and Pt of one-twentieth or more to one-half or less of the Ru content. The main constituent of the tip 9 is particularly preferably Ir. The tip 9 particularly preferably contains Rh of 7 mass % or more to 21 mass % or less, Ru of 6 mass % or more to 13 mass % or less, and Pt of one-twentieth or more to one-half or less of the Ru content.

The tip 9 with the composition allows reducing the oxidative consumption without an influence from the oxygen concentration under the environment of the tip being exposed, thereby providing a spark plug featuring good durability.

The tip 9 is the Ir alloy whose main constituent is Ir. Here, the main constituent means a constituent whose content is the most among the constituents contained in the tip 9. The content of Ir is preferably 39 mass % or more to 87.75 mass % or less with respect to the total mass of the tip. In addition, the total mass of Ir, Rh, Ru, Pt, and a constituent contained as necessary is appropriately set so as to be 100 mass %. Since the Ir is a material having a high melting point, the melting point of 2454° C., the Ir improves heat resistance of the tip 9.

The tip 9 contains the Rh at a proportion in the range. When the tip 9 contains the Rh at the proportion in the range, the Ir is less likely to be oxidatively vaporized from the surface of the tip 9. Accordingly, regardless of the oxygen concentration, such tip 9 improves the oxidation resistance more than the tip made of pure Ir. With the Rh whose content within the range, under the low oxygen concentration atmosphere, the higher Rh content is increases the Rh concentration of a grain boundary. This brings a trend of reducing oxidized vapor of the Ir. On the other hand, under the high oxygen concentration atmosphere, the lower Rh content is less likely to generate a needle-shaped Rh oxide at the surface of the tip 9, improving the oxidation resistance. The Rh content of less than 7 mass % fails to obtain an effect of reducing the oxidized vapor of Ir, failing to reduce the oxidative consumption. The excess of the Rh content of 31 mass % relatively reduces the Ir content. Accordingly, the high melting point, which is the property of Ir, is not exploited, declining the heat resistance of the tip 9.

The tip 9 contains the Ru at the proportion in the range. When the tip 9 contains the Ru at the proportion in the range, the Ir is less likely to be oxidatively vaporized from the surface of the tip 9, compared with the tip made of the Ir alloy containing only Ir and Rh. Accordingly, such tip 9 improves the oxidation resistance under the low oxygen concentration atmosphere. The Ru content of less than 5 mass % fails to obtain the effect of reducing the oxidized vapor of Ir, failing to reduce the oxidative consumption. The excess of the Ru content of 20 mass % relatively reduces the Ir content. Accordingly, the high melting point, which is the property of Ir, is not exploited, declining the heat resistance of the tip 9.

The tip 9 contains Pt of one-twentieth or more to one-half or less of the Ru content. When the tip 9 contains the Pt at the proportion in the range, the oxidative consumption performance of the tip 9 under the high oxygen concentration atmosphere can be reduced while maintaining the reduction effect of the oxidative consumption of the tip under the low oxygen concentration atmosphere. The Pt content of less than one-twentieth of the Ru content cannot provide the effect brought by containing the Pt. Therefore, the oxidative consumption of the tip under the high oxygen concentration atmosphere cannot be reduced. The excess of the Pt content of one-half of the Ru content declines the reduction effect of the oxidative consumption of the tip under the low oxygen concentration atmosphere brought by the Ru.

The reason for allowing the tip according to this invention to reduce the oxidative consumption is probably as follows. According to the examination by the inventors, the tip made of the Ir alloy containing Ir, Rh, and Ru can sufficiently reduce the oxidative consumption of the tip at the Air/Fuel ratio of air-fuel mixture of around 12 and the inside of the combustion chamber being under the low oxygen concentration atmosphere. However, at the Air/Fuel ratio of around 14 and the inside of the combustion chamber being under the high oxygen concentration atmosphere, sufficiently reducing the oxidative consumption of the tip may fail.

At a superficial layer of the tip 9 made of the Ir alloy containing Ir, Rh, and Ru being exposed under the high oxygen concentration atmosphere, the needle-shaped Rh oxide, which is formed by oxidation of the Rh, is formed. Such needle-shaped Rh oxide roughens a structure of the superficial layer of the tip 9, different from a fine oxide film. Therefore, oxygen is likely to invade the inside of the tip. Consequently, the Ir is likely to be oxidized and volatilized, failing to reduce the oxidative consumption of the tip 9. On the other hand, with the tip made of the Ir alloy containing the Ir, Rh, Ru, and further Pt, the needle-shaped Rh oxide is not formed at the superficial layer of the tip 9 exposed under the high oxygen concentration atmosphere. Instead, the Rh, that is excellent in the oxidation resistance, is incrassated at the surface as a metal. This makes it difficult for the oxygen to invade the inside of the tip. Consequently, the Ir is less likely to be oxidatively vaporized, ensuring reducing the oxidative consumption of the tip 9. The Pt content to prevent formation of the needle-shaped Rh oxide relates to the Ru content. That is, under the high oxygen concentration atmosphere, the Ir alloy containing Ir and Rh does not form the needle-shaped Rh oxide. Containing the Ru to this and forming the Ir alloy containing Ir, Rh, and Ru forms the needle-shaped Rh oxide. Accordingly, containing (i.e., restraining) Pt, which affects the formation of the needle-shaped Rh oxide, to one-twentieth or more of the Ru content allows reducing the formation of the needle-shaped Rh oxide.

Under the low oxygen concentration atmosphere, different from the high oxygen concentration atmosphere, the tip 9 made of the Ir alloy containing Ir, Rh, and Ru does not form the needle-shaped Rh oxide at the superficial layer, thus allowing reducing the oxidative consumption of the tip. Under the low oxygen concentration atmosphere, containing Pt to the Ir, Rh, and Ru inversely increasing a diffusion speed of the Ir is likely to promote the oxidative consumption of the tip 9. Accordingly, setting the content of Pt to one-half or less of the Ru content, which has an effect of reducing the diffusion speed of the Ir, allows maintaining the effect of reducing the oxidative consumption of the tip.

The tip 9 preferably contains Ni of 0.1 mass % or more to 4.5 mass % or less. The use of the Ir—Rh alloy whose main constituent is Ir and contains the Rh possibly wears the side portion of the tip to be selectively hollowed out from one direction. When the tip 9 contains the Ni of 0.1 mass % or more, this allows reducing such wear of the side portion. When the tip contains the Ni of 4.5 mass % or less, this allows reducing the side portion wear and reducing the wear of the tip caused by containing the Ni whose melting point is comparatively low.

It is only necessary that the tip 9 of this invention contains Ir, Rh, Ru, and Pt in the above-described range. The tip 9 may contain the Ni as necessary. The tip 9 may contain Co, Mo, Re, W, Al, Si, and a similar material and inevitable impurities at the content smaller than 5 mass %. These respective constituents are contained within the above-described ranges of the contents of the respective constituents and to meet the total mass of the respective constituents of 100 mass %. As the inevitable impurities, for example, Cr, Si, and Fe can be listed. The smaller contents of these inevitable impurities are preferred. However, the inevitable impurities may be contained within the range of ensuring solving the problem of this invention. Regarding the inevitable impurities, assuming the total mass of the above-described constituents as 100 parts by mass, the proportion of one kind of the above-described inevitable impurities may be 0.1 parts by mass or less and the total proportion of the all kinds of contained inevitable impurities may be 0.2 parts by mass or less.

The content of the respective constituents contained in the tip 9 can be measured as follows. That is, first, the tip 9 is cut at a plane including the center axial line to expose the cut cross section. A plurality of any given portions are selected at the cut cross section of the tip 9. Using an EPMA, Wavelength Dispersive X-ray Spectrometer (WDS) analysis is performed. Thus, a mass composition of each portion is measured. Next, an arithmetic average value of the measured values, which are measured at the plurality of portions, is calculated, and the average value is used as the composition of the tip 9. Note that the fusion portion, which is formed at welding the tip 9 and the center electrode 4, is removed from the measured portion.

The area S of the tip 9 when projecting the tip 9 to an imaginary plane parallel to a bonding surface of the center electrode 4 and the tip 9 is preferably 0.07 $mm^2$ or more. The area S is more preferably 0.10 $mm^2$ or more. The area S is further preferably 0.15 $mm^2$ or more. The area S of within the range is less likely to increase a temperature compared with a thin tip. This allows further reducing the oxidative consumption of the tip 9. From the aspect of economic efficiency or similar efficiency, the area S is preferably 3.5 $mm^2$ or less.

Figure 2:
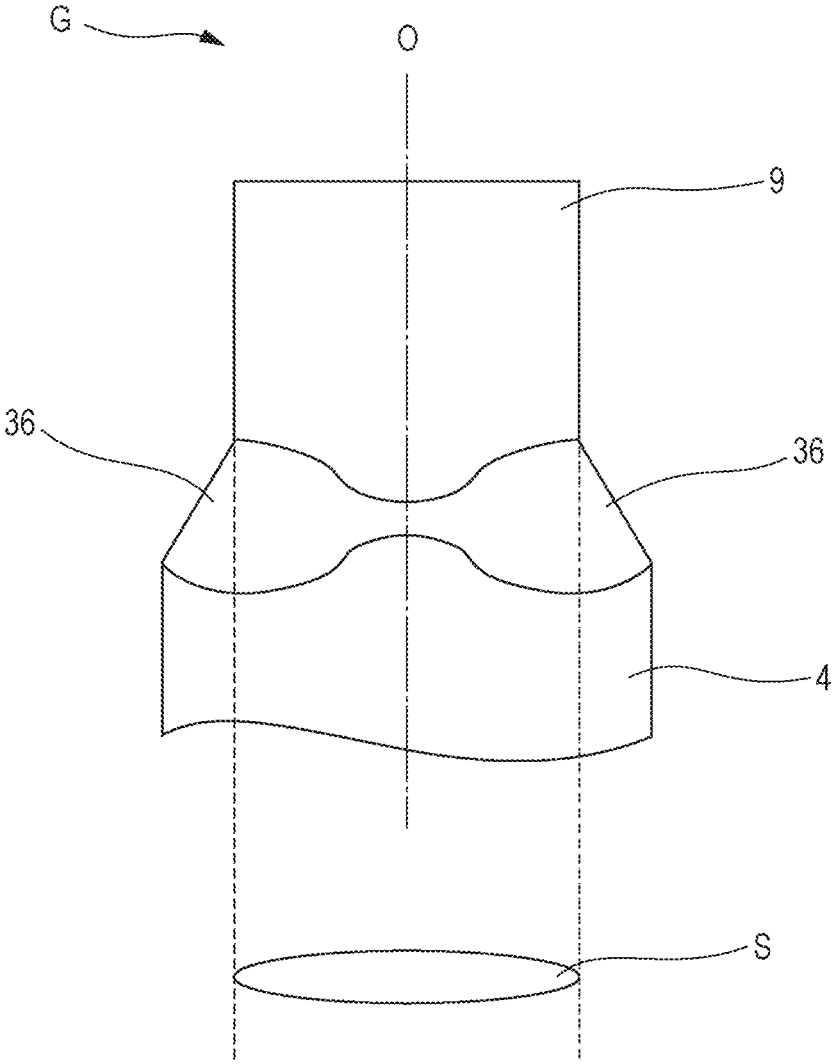
FIG. 2 is an explanatory view of a main part of an exemplary bonded portion of a tip and a center electrode in the spark plug according to this invention.
Figure 3:
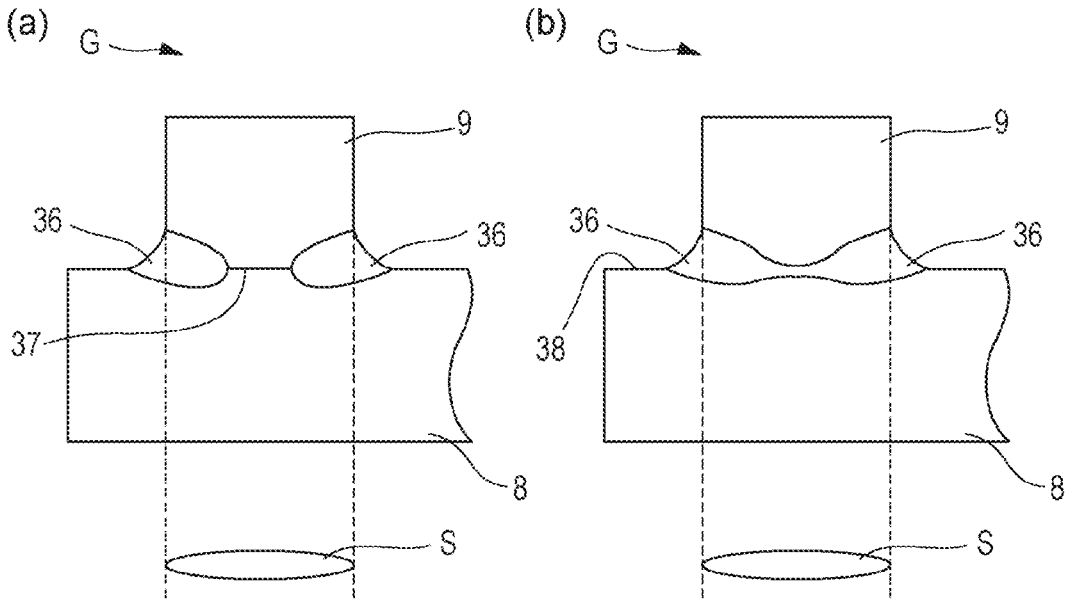
FIG. 3 is explanatory views of main parts of exemplary bonded portions of the tips and the ground electrodes in the spark plug according to this invention.

The area S is measured as follows. As shown in FIG. 2, in the case where the tip 9 is bonded to the center electrode 4, the bonding surface of the tip 9 and the center electrode 4 are inferred to be perpendicular to the axial line O. A tomographic image parallel from the distal end direction of the axial line O to the bonding surface is taken with a projector. A plurality of tomographic images are obtained between the distal end of the tip 9 and the boundary between the tip 9 and a fusion portion 36. Among the obtained tomographic images of the tip, an area of the tomographic image of the tip 9 with the largest area is used as the area S. Assume the case where the tip is bonded to the ground electrode 4 and as shown in FIG. 3(*a*), a boundary surface 37 between the tip and the surface of the ground electrode 8 before welding remains. Since this boundary surface 37 is the bonding surface, the tomographic image of the tip 9 is taken in the direction perpendicular to this boundary surface 37, that is, from the direction that the gap G locates at the tip 9 to the direction parallel to the boundary surface 37 with the projector. Then, as described above, the area S is measured. As shown in FIG. 3(*b*), in the case where the fusion portion 36, which is formed by welding the tip 9 and the ground electrode 8, is radially and continuously formed and the boundary surface between the tip and the surface of the ground electrode 8 before welding does not remain, the bonding surface is inferred as described below. In the case where the tip 9 is bonded to the ground electrode 8, since a surface 38 of the ground electrode 8 to which the tip 9 is bonded remains at the peripheral area of the tip 9, it is inferred that this surface 38 is parallel to the bonding surface. The tomographic image of the tip 9 parallel to the surface 38 is taken from the direction perpendicular to the surface 38 with the projector. Then, as described above, the area S is measured.

The spark plug 1 is, for example, manufactured as follows. First, for the tip 9 to be bonded to the center electrode 4, metal constituents where the content of each constituent falls within the above-described range are combined, thus raw material powder is prepared. Arc melting is performed on this raw material powder to form an ingot. This ingot is hot forged to form a rod material. Next, this rod material is groove-rolled by several times, and if necessary, swaging is performed. Then, by performing a wire drawing treatment by die drawing, the rod material with a circular cross section is formed. This rod material is cut to a predetermined length, thus forming the column-shaped tip 9. The shape of the tip 9 is not limited to the columnar shape. For example, the wire drawing treatment is performed on the ingot with a quadrangular die to process the ingot into a square log. The square log is cut to the predetermined length so as to form the square log into, for example, a prismatic shape.

In the case where the tip is bonded to the ground electrode 8, the tip may be manufactured by the similar method to the tip 9 to be bonded to the center electrode 4, or the tip may be manufactured by the conventionally-known method.

For the center electrode 4 and the ground electrode 8, for example, using a vacuum melting furnace, a hot metal alloy with a desired composition is prepared. The wire drawing treatment or a similar treatment is performed on this hot metal to appropriately adjust the hot metal to the predetermined shape and predetermined dimensions. Assume the case where the center electrode 4 is formed of the outer layer and the core portion, which is disposed so as to be embedded into the axial center portion of this outer layer. For the center electrode 4, an inner material made of the Cu alloy, which exhibits higher thermal conductivity than an outer material, or a similar material is inserted into the outer material made of the Ni alloy or a similar material formed into a cup. By plastic work such as an extrusion process, the center electrode 4 with the core portion at the inside of the outer layer is formed. The ground electrode 8 also may be formed of the outer layer and the core portion similar to the center electrode 4. In this case, similar to the center electrode 4, the inner material is inserted into the outer material formed into the cup, and the plastic work such as the extrusion process is performed. Then, the member on which the plastic work is performed to have an approximately prismatic shape can be the ground electrode 8.

Subsequently, to the end face of the metal shell 7 formed to be the predetermined shape by the plastic work or similar work, the one end portion of the ground electrode 8 is bonded by electrical resistance welding, laser beam welding, or a similar welding. Next, Zn plating or Ni plating is performed on the metal shell 7 to which the ground electrode 8 is bonded. After the Zn plating or the Ni plating, trivalent chromate treatment may be performed. Further, the plating performed on the ground electrode may be peeled.

Next, the tip 9 fabricated as described above is melted and fixed to the center electrode 4 by, for example, the resistance welding and/or the laser beam welding. In the case where the tip 9 is bonded to the center electrode 4 by the resistance welding, for example, the tip 9 is installed at the predetermined position of the center electrode 4 and the resistance welding is performed while pressing the tip 9. In the case where the tip 9 is bonded to the center electrode 4 by the laser beam welding, for example, the tip 9 is installed at the predetermined position of the center electrode 4. Then, laser beam is irradiated on a contact portion of the tip 9 and the center electrode 4 from a direction parallel to the contact surface of the tip 9 and the center electrode 4 partially or across the whole circumference. Additionally, after performing the resistance welding, the laser beam welding may be performed. In the case where the tip is bonded to the ground electrode 8, the tip can be bonded by the method similar to bonding the tip 9 to the center electrode 4.

On the other hand, the insulator 3 is fabricated by sintering ceramic or a similar material into a predetermined shape. The center electrode 4 is disposed to be inserted into the axial hole 2 of this insulator 3. The composition forming the first seal body 22, the composition forming the resistor 21, and the composition forming the second seal body 23 are pre-compressed into the axial hole 2 in this order for filling the axial hole 2. Next, while press-fitting the terminal metal fitting 5 from the end portion in the axial hole 2, the compositions are compressed and heated. Thus, the compositions are sintered, forming the resistor 21, the first seal body 22, and the second seal body 23. Next, to metal shell 7 to which the ground electrode 8 is bonded, the insulator 3 to which this center electrode 4 or a similar member is secured is assembled. Finally, the distal end portion of the ground electrode 8 is bent to the center electrode 4 side such that the one end of the ground electrode 8 is opposed to the distal end portion of the center electrode 4, thus manufacturing the spark plug 1.

The spark plug 1 according to the present invention is used as an ignition plug for the internal combustion engine for vehicles, for example, a gasoline engine. The spark plug 1 has a screw hole at a head (not shown), which defines and forms a combustion chamber of the internal combustion engine. The screw portion 24 is screwed with the screw hole to secure the spark plug 1 to the predetermined position. The spark plug 1 according to this invention is applicable to any internal combustion engine. Since the spark plug 1 features excellent oxidation resistance without an influence from the oxygen concentration under an environment where the tip is exposed, the spark plug 1 is, for example, particularly suitable for the internal combustion engine such as a lean burn engine.

The spark plug 1 according to the invention is not limited to the above-described embodiment, and various modifications can be performed within the range which can achieve the object of the invention. For example, with the spark plug 1, the front end surface of the tip 9, which is disposed at the center electrode 4, and the side surface of the ground electrode 8 are opposed via the gap G in the axial line O direction. However, with this invention, the side surface of the tip, which is disposed at the center electrode, and the front end surface of the tip disposed at the ground electrode may be disposed to be opposed via a gap in the radial direction of the center electrode. In this case, the ground electrode, which is opposed to the side surface of the tip disposed at the center electrode, may be disposed by a single or plural.

EXAMPLES

Fabrication of Specimen of Spark Plug

A tip to be bonded to a center electrode was obtained as follows. Raw material powders with a predetermined composition were combined, and arc melting was performed on the powder to form an ingot. Hot forging, hot rolling, and hot swaging were performed on this ingot. Furthermore, the wire drawing treatment was performed to form a rod material with a circular cross section. This rod material was cut to a predetermined length, thus obtaining the column-shaped tip at a diameter of 0.5 mm and a height of 0.7 mm.

The main constituent of the tip to be bonded to the ground electrode was Pt. Raw material powder with a composition whose second constituent is Ni was combined. The tip was manufactured similar to the tip to be bonded to the center electrode, thus obtaining the column-shaped tip at a diameter of 0.9 and a height of 0.4 mm.

The obtained tips were each bonded to the center electrode and the ground electrode by the laser beam welding. Thus, the spark plug specimen with the structure shown in FIG. 1 was manufactured.

Method for Measuring Composition of Tip

Mass compositions of the compositions of the tips to be bonded to the center electrodes shown in Tables 1 to 3 were measured by WDS analysis with an EPMA (JXA-8500F manufactured by JEOL Ltd.). First, the tip was cut off at the plane including the center axial line of the tip. As described above, a plurality of measurement points were selected at this cut cross section, and the mass composition was measured. Next, an arithmetic average value of the plurality of measured values, which were measured, was calculated. This average value was used as the composition of the tip for the center electrode. Further, when a measured region accommodating a spot diameter is on a fusion portion, which is formed by melting of the tip and the center electrode, a result of the measurement point was removed.

Method for Measuring Area S of Tip

The area S of the tip shown in Table 3 was determined as follows. As described above, a tomographic image of the tip parallel to a bonding surface was taken in the direction perpendicular to the bonding surface of the tip and the center electrode, that is, from a direction where the gap locates at the tip with the projector. A plurality of tomographic images were obtained between the distal end of the tip and a boundary between the tip and the fusion portion. Among the obtained tomographic images of the tips, an area of the tomographic image of the tip with the largest area was determined as the area S.

Method for Durability Test

The manufactured spark plug specimen was mounted to an engine with supercharger for testing. The durability test was conducted at an Air/Fuel ratio of air-fuel mixture (air/fuel) of 14 or 12 and at full throttle with a state of an engine revolution of 6000 rpm maintained, and the engine was operated for 200 hours. Further, the ignition timing with the Air/Fuel ratio of 14 was BTDC 35°, and intake air pressure was −30 KPa. The ignition timing with the Air/Fuel ratio of 12 was BTDC 30°, and the intake air pressure was −20 KPa.

Evaluation on Oxidation Resistance

The durability test was conducted. The volumes of the tip bonded to the center electrode were measured with a CT scan (TOSCANER-32250 μhd manufactured by TOSHIBA CORPORATION) before and after the durability test. A decreased amount of a volume $V_2$ of the tip after the durability test with respect to a volume $V_1$ of the tip before the durability test $[\{(V_1-V_2)/V_1\}\times100]$ was calculated. This value was regarded as a wear volume and the oxidation resistance was evaluated based on the following criteria. The results are shown in Table 1 and Table 2.

When the Air/Fuel ratio is 14

A: The wear volume is 20% or more. (zero points)

B: The wear volume is 18% or more to less than 20%. (one point)

C: The wear volume is 16% or more to less than 18%. (three points)

D: The wear volume is 14% or more to less than 16%. (five points)

E: The wear volume is 12% or more to less than 14%. (seven points)

F: The wear volume is 10% or more to less than 12%. (eight points)

G: The wear volume is less than 10%. (nine points)

When the Air/Fuel ratio is 12

A: The wear volume is 30% or more. (zero points)

B: The wear volume is 26% or more to less than 30%. (one point)

C: The wear volume is 22% or more to less than 26%. (two points)

D: The wear volume is 18% or more to less than 22%. (three points)

E: The wear volume is 15% or more to less than 18%. (four points)

F: The wear volume is 12% or more to less than 15%. (five points)

G: The wear volume is less than 12% (six points)

Overall Determination

Evaluation results when the Air/Fuel ratio of 14 and 12 were indicated by points as described above, and the durability test was determined by the total points of these results.

A: At least one of the points of the evaluation results at the Air/Fuel ratio of 14 and the Air/Fuel ratio of 12 is zero points or the total point is six points or less.

B: The total point of the evaluation results at the Air/Fuel ratio of 14 and the Air/Fuel ratio of 12 is seven points or more to nine points or less.

C: The total point of the evaluation results at the Air/Fuel ratio of 14 and the Air/Fuel ratio of 12 is ten points or more and 11 points or less.

D: The total point of the evaluation results at the Air/Fuel ratio of 14 and the Air/Fuel ratio of 12 is 12 points or more and 13 points or less.

E: The total point of the evaluation results at the Air/Fuel ratio of 14 and the Air/Fuel ratio of 12 is 14 points or more.

Evaluation on Wear of Side Portion

The durability test was conducted. The volumes of the tip bonded to the center electrode were measured with the CT scan (TOSCANER-32250 μhd manufactured by TOSHIBA CORPORATION) before and after the durability test. A decreased amount of a minimum value $R_2$ of a diameter of the tip after the durability test with respect to a maximum value $R_1$ of the diameter of the tip before the durability test $[\{(R_1-R_2)/R_1\}\times100]$ was calculated. This value was regarded as a side portion wearing rate of the tip, and the wear of side portion was evaluated based on the following criteria. The results are shown in Table 1 and Table 2.

0: The side portion wearing rate is 10% or more.

1: The side portion wearing rate is less than 10%.

TABLE 1

| | Test | Composition (mass %) | | | | | Wear Volume | | | Side |
|---|---|---|---|---|---|---|---|---|---|---|
| | | | | | | | Air/Fuel Ratio: | Air/Fuel Ratio: | Overall | Portion Wearing |
| | No. | Ir | Rh | Ru | Ni | Pt | 14 | 12 | Determination | Rate |
| Comparative Example | 1 | 88 | 6 | 5 | 0 | 1 | A | A | A | 0 |
| | 2 | 80 | 6 | 13 | 0 | 1 | A | A | A | 0 |
| | 3 | 78 | 6 | 15 | 0 | 1 | A | A | A | 0 |
| | 4 | 76 | 6 | 17 | 0 | 1 | A | A | A | 0 |
| | 5 | 73 | 6 | 20 | 0 | 1 | A | A | A | 0 |
| | 6 | 88 | 7 | 4 | 0 | 1 | A | A | A | 0 |
| Working Example | 7 | 87 | 7 | 5 | 0 | 1 | E | E | C | 0 |
| | 8 | 86 | 7 | 6 | 0 | 1 | G | F | E | 0 |
| | 9 | 79 | 7 | 13 | 0 | 1 | G | F | E | 0 |
| | 10 | 78 | 7 | 14 | 0 | 1 | F | E | D | 0 |
| | 11 | 77 | 7 | 15 | 0 | 1 | F | E | D | 0 |
| | 12 | 76 | 7 | 16 | 0 | 1 | E | E | C | 0 |
| | 13 | 75 | 7 | 17 | 0 | 1 | E | E | C | 0 |
| | 14 | 74 | 7 | 18 | 0 | 1 | C | E | B | 0 |
| | 15 | 72 | 7 | 20 | 0 | 1 | C | E | B | 0 |
| Comparative Example | 16 | 71 | 7 | 21 | 0 | 1 | A | B | A | 0 |
| Working Example | 17 | 80 | 8 | 11 | 0 | 1 | G | F | E | 0 |
| | 18 | 68 | 20 | 11 | 0 | 1 | G | F | E | 0 |
| Comparative Example | 19 | 74 | 21 | 4 | 0 | 1 | A | A | A | 0 |
| Working Example | 20 | 73 | 21 | 5 | 0 | 1 | E | E | C | 0 |
| | 21 | 72 | 21 | 6 | 0 | 1 | G | F | E | 0 |
| | 22 | 65 | 21 | 13 | 0 | 1 | G | F | E | 0 |
| | 23 | 64 | 21 | 14 | 0 | 1 | F | E | D | 0 |
| | 24 | 72 | 22 | 5 | 0 | 1 | E | E | C | 0 |
| | 25 | 71 | 22 | 6 | 0 | 1 | E | G | D | 0 |
| | 26 | 64 | 22 | 13 | 0 | 1 | E | G | D | 0 |
| Comparative Example | 27 | 71 | 24 | 4 | 0 | 1 | A | B | A | 0 |
| Working Example | 28 | 70 | 24 | 5 | 0 | 1 | E | E | C | 0 |
| | 29 | 69 | 24 | 6 | 0 | 1 | E | G | D | 0 |
| | 30 | 60 | 24 | 15 | 0 | 1 | E | F | D | 0 |
| | 31 | 59 | 24 | 16 | 0 | 1 | E | E | C | 0 |
| | 32 | 58 | 24 | 17 | 0 | 1 | E | E | C | 0 |
| | 33 | 57 | 24 | 18 | 0 | 1 | C | E | B | 0 |
| | 34 | 69 | 25 | 5 | 0 | 1 | D | F | C | 0 |
| | 35 | 68 | 25 | 6 | 0 | 1 | D | G | C | 0 |
| | 36 | 59 | 25 | 15 | 0 | 1 | D | F | C | 0 |
| | 37 | 58 | 25 | 16 | 0 | 1 | D | F | C | 0 |
| Comparative Example | 38 | 68 | 27 | 4 | 0 | 1 | A | C | A | 0 |
| Working Example | 39 | 67 | 27 | 5 | 0 | 1 | D | F | C | 0 |
| | 40 | 66 | 27 | 6 | 0 | 1 | D | G | C | 0 |
| | 41 | 55 | 27 | 17 | 0 | 1 | D | F | C | 0 |
| | 42 | 54 | 27 | 18 | 0 | 1 | C | E | B | 0 |
| | 43 | 66 | 28 | 5 | 0 | 1 | C | F | B | 0 |
| | 44 | 65 | 28 | 6 | 0 | 1 | C | G | B | 0 |
| | 45 | 54 | 28 | 17 | 0 | 1 | C | F | B | 0 |
| | 46 | 53 | 28 | 18 | 0 | 1 | C | E | B | 0 |

TABLE 1-continued

| | Test No. | Composition (mass %) Ir | Rh | Ru | Ni | Pt | Wear Volume Air/Fuel Ratio: 14 | Air/Fuel Ratio: 12 | Overall Determination | Side Portion Wearing Rate |
|---|---|---|---|---|---|---|---|---|---|---|
| Comparative Example | 47 | 64 | 31 | 4 | 0 | 1 | A | D | A | 0 |
| Working Example | 48 | 63 | 31 | 5 | 0 | 1 | C | F | B | 0 |
| | 49 | 62 | 31 | 6 | 0 | 1 | C | G | B | 0 |
| | 50 | 48 | 31 | 20 | 0 | 1 | C | E | B | 0 |
| Comparative Example | 51 | 47 | 31 | 21 | 0 | 1 | A | E | A | 0 |
| | 52 | 62 | 32 | 5 | 0 | 1 | C | A | A | 0 |
| | 53 | 61 | 32 | 6 | 0 | 1 | C | A | A | 0 |
| | 54 | 47 | 32 | 20 | 0 | 1 | C | A | A | 0 |

TABLE 2

| | Test No. | Composition (mass %) Ir | Rh | Ru | Ni | Pt | Wear Volume Air/Fuel Ratio: 14 | Air/Fuel Ratio: 12 | Overall Determination | Side Portion Wearing Rate |
|---|---|---|---|---|---|---|---|---|---|---|
| Comparative Example | 55 | 69 | 20 | 11 | 0 | 0 | A | F | A | 0 |
| | 56 | 68.5 | 20 | 11 | 0 | 0.5 | A | F | A | 0 |
| Working Example | 57 | 68.45 | 20 | 11 | 0 | 0.55 | G | F | E | 0 |
| | 58 | 63.5 | 20 | 11 | 0 | 5.5 | G | F | E | 0 |
| Comparative Example | 59 | 63 | 20 | 11 | 0 | 6 | G | A | A | 0 |
| | 60 | 81 | 8 | 11 | 0 | 0 | A | F | A | 0 |
| | 61 | 80.5 | 8 | 11 | 0 | 0.5 | A | F | A | 0 |
| Working Example | 62 | 80.45 | 8 | 11 | 0 | 0.55 | G | F | E | 0 |
| | 63 | 75.5 | 8 | 11 | 0 | 5.5 | G | F | E | 0 |
| Comparative Example | 64 | 75 | 8 | 11 | 0 | 6 | G | A | A | 0 |
| | 65 | 64 | 16 | 20 | 0 | 0 | A | E | A | 0 |
| | 66 | 63.05 | 16 | 20 | 0 | 0.95 | A | E | A | 0 |
| Working Example | 67 | 63 | 16 | 20 | 0 | 1 | C | E | B | 0 |
| | 68 | 54 | 16 | 20 | 0 | 10 | C | E | B | 0 |
| Comparative Example | 69 | 53.5 | 16 | 20 | 0 | 10.5 | C | A | A | 0 |
| | 70 | 63 | 22 | 15 | 0 | 0 | A | F | A | 0 |
| | 71 | 62.3 | 22 | 15 | 0 | 0.7 | A | F | A | 0 |
| Working Example | 72 | 62.25 | 22 | 15 | 0 | 0.75 | E | F | D | 0 |
| | 73 | 55.5 | 22 | 15 | 0 | 7.5 | E | F | D | 0 |
| Comparative Example | 74 | 55 | 22 | 15 | 0 | 8 | E | A | A | 0 |
| | 75 | 59 | 25 | 16 | 0 | 0 | A | F | A | 0 |
| | 76 | 58.25 | 25 | 16 | 0 | 0.75 | A | F | A | 0 |
| Working Example | 77 | 58.2 | 25 | 16 | 0 | 0.8 | D | F | C | 0 |
| | 78 | 51 | 25 | 16 | 0 | 8 | D | F | C | 0 |
| Comparative Example | 79 | 50.5 | 25 | 16 | 0 | 8.5 | D | A | A | 0 |
| | 80 | 57 | 31 | 12 | 0 | 0 | A | E | A | 0 |
| | 81 | 56.45 | 31 | 12 | 0 | 0.55 | A | E | A | 0 |
| Working Example | 82 | 56.4 | 31 | 12 | 0 | 0.6 | C | E | B | 0 |
| | 83 | 51 | 31 | 12 | 0 | 6 | C | E | B | 0 |
| Comparative Example | 84 | 50.5 | 31 | 12 | 0 | 6.5 | C | A | A | 0 |
| | 85 | 68.9 | 20 | 11 | 0.1 | 0 | A | F | A | 1 |
| | 86 | 68.4 | 20 | 11 | 0.1 | 0.5 | A | F | A | 1 |
| Working Example | 87 | 68.35 | 20 | 11 | 0.1 | 0.55 | G | F | E | 1 |
| | 88 | 63.4 | 20 | 11 | 0.1 | 5.5 | G | F | E | 1 |
| Comparative Example | 89 | 62.9 | 20 | 11 | 0.1 | 6 | G | A | A | 1 |
| | 90 | 68 | 20 | 11 | 1 | 0 | A | F | A | 1 |
| | 91 | 67.5 | 20 | 11 | 1 | 0.5 | A | F | A | 1 |
| Working Example | 92 | 67.45 | 20 | 11 | 1 | 0.55 | G | F | E | 1 |
| | 93 | 62.5 | 20 | 11 | 1 | 5.5 | G | F | E | 1 |
| Comparative Example | 94 | 62 | 20 | 11 | 1 | 6 | G | A | A | 1 |
| | 95 | 64.5 | 20 | 11 | 4.5 | 0 | A | F | A | 1 |
| | 96 | 64 | 20 | 11 | 4.5 | 0.5 | A | F | A | 1 |
| Working Example | 97 | 63.95 | 20 | 11 | 4.5 | 0.55 | G | F | E | 1 |
| | 98 | 59 | 20 | 11 | 4.5 | 5.5 | G | F | E | 1 |
| Comparative Example | 99 | 58.5 | 20 | 11 | 4.5 | 6 | G | A | A | 1 |
| | 100 | 64 | 20 | 11 | 5 | 0 | A | F | A | 0 |
| | 101 | 63.5 | 20 | 11 | 5 | 0.5 | A | F | A | 0 |
| Working Example | 102 | 63.45 | 20 | 11 | 5 | 0.55 | G | F | E | 0 |
| | 103 | 58.5 | 20 | 11 | 5 | 5.5 | G | F | E | 0 |
| Comparative Example | 104 | 58 | 20 | 11 | 5 | 6 | G | A | A | 0 |

TABLE 2-continued

| | Test | Composition (mass %) | | | | | Wear Volume | | | Side |
|---|---|---|---|---|---|---|---|---|---|---|
| | | | | | | | Air/Fuel Ratio: | Air/Fuel Ratio: | Overall | Portion Wearing |
| | No. | Ir | Rh | Ru | Ni | Pt | 14 | 12 | Determination | Rate |
| Working | 105 | 80 | 8 | 11 | 0 | 1 | G | F | E | 0 |
| Example | 106 | 79.9 | 8 | 11 | 0.1 | 1 | G | F | E | 1 |
| | 107 | 79 | 8 | 11 | 1 | 1 | G | F | E | 1 |
| | 108 | 75.5 | 8 | 11 | 4.5 | 1 | G | F | E | 1 |
| | 109 | 75 | 8 | 11 | 5 | 1 | G | F | E | 0 |
| | 110 | 63 | 16 | 20 | 0 | 1 | C | E | B | 0 |
| | 111 | 62.9 | 16 | 20 | 0.1 | 1 | C | E | B | 1 |
| | 112 | 62 | 16 | 20 | 1 | 1 | C | E | B | 1 |
| | 113 | 58.5 | 16 | 20 | 4.5 | 1 | C | E | B | 1 |
| | 114 | 58 | 16 | 20 | 5 | 1 | C | E | B | 0 |
| Comparative | 115 | 69 | 30 | 1 | 0 | 0 | A | A | A | 0 |
| Example | 116 | 68.5 | 30 | 1 | 0 | 0.5 | A | D | A | 0 |
| | 117 | 68 | 30 | 1 | 0 | 1 | A | A | A | 0 |
| | 118 | 65 | 30 | 5 | 0 | 0 | A | F | A | 0 |
| Working Example | 119 | 64 | 30 | 5 | 0 | 1 | C | F | B | 0 |
| Comparative Example | 120 | 62 | 30 | 5 | 0 | 3 | C | A | A | 0 |
| | 121 | 64 | 30 | 6 | 0 | 0 | A | F | A | 0 |
| Working Example | 122 | 63 | 30 | 6 | 0 | 1 | C | F | B | 0 |
| Comparative Example | 123 | 60 | 30 | 6 | 0 | 4 | C | A | A | 0 |
| | 124 | 57.5 | 30 | 12.5 | 0 | 0 | A | F | A | 0 |
| Working Example | 125 | 56.5 | 30 | 12.5 | 0 | 1 | C | F | B | 0 |
| Comparative Example | 126 | 50.5 | 30 | 12.5 | 0 | 7 | C | A | A | 0 |
| | 127 | 91 | 8 | 0 | 1 | 0 | A | C | A | 1 |
| | 128 | 90 | 8 | 0 | 1 | 1 | A | C | A | 1 |
| | 129 | 92 | 8 | 0 | 0 | 0 | A | C | A | 0 |
| | 130 | 91 | 8 | 0 | 0 | 1 | A | C | A | 0 |

Evaluation on Oxidation Resistance Depending on Difference in Thickness of Tip

The thickness of the column-shaped tips was changed and the Air/Fuel ratio was set to 12. Otherwise, the tips were evaluated on the oxidation resistance similar to the test Nos. 1 to 54. Further, the area S when the tip was projected to the imaginary plane parallel to the bonding surface of the center electrode and the tip was measured as described above. The values were indicated in Table 3 as a reference of the thickness of the tip.

TABLE 3

| | Test | Composition (mass %) | | | | | Area S of Tip | Wear Volume |
|---|---|---|---|---|---|---|---|---|
| | No. | Ir | Rh | Ru | Ni | Pt | ($mm^2$) | Air/Fuel Ratio: 12 |
| Working | 127 | 67 | 20 | 11 | 1 | 1 | 0.06 | C |
| Example | 128 | 67 | 20 | 11 | 1 | 1 | 0.07 | D |
| | 129 | 67 | 20 | 11 | 1 | 1 | 0.10 | E |
| | 130 | 67 | 20 | 11 | 1 | 1 | 0.15 | F |
| | 131 | 67 | 20 | 11 | 1 | 1 | 0.20 | F |

As shown in Table 1 and Table 2, the tip with the composition included in the range of this invention was able to reduce the oxidative consumption regardless of the Air/Fuel Ratio of the air-fuel mixture, that is, without an influence from the oxygen concentration under the environment where the tip was exposed. On the other hand, the tip with the composition outside of the range of this invention at least had more oxidation wear volume at the Air/Fuel ratio of 14, inferior in the oxidation resistance.

As shown in Table 2, the tip containing Ni by the predetermined amount exhibited small wearing rate of the side portion of the tip compared with the tip that did not contain Ni.

As shown in Table 3, the thicker the tip was, the smaller the oxidation wear volume was, and the oxidation resistance was good.

DESCRIPTION OF REFERENCE SIGNS

1 Spark plug
2 Axial hole
3 Insulator
4 Center electrode
5 Terminal metal fitting
6 Connecting portion
7 Metal shell
8 Ground electrode
9 Tip
11 Rear end body portion
12 Large-diameter portion
13 Front end body portion
14 Insulator nose portion
15 Shelf portion
16 Collar portion
17 Step part
18 Tapered portion
19 Plate packing
21 Resistor
22 First seal body
23 Second seal body
24 Screw portion
25 Gas seal portion
26 Tool engagement portion

27 Crimping portion
28, 29 Packing
30 Talc
32 Protrusion
34 Rear end portion
35 Rod-shaped portion
36 Fusion portion
37 Boundary surface
38 Surface
G Gap Having described the invention, the following is claimed:

1. A spark plug, comprising:

a center electrode; and a ground electrode disposed providing a gap with the center electrode, wherein at least one of the center electrode and the ground electrode includes a tip forming the gap, and the tip has a main constituent of Ir and contains Rh of 7 mass % or more to 31 mass % or less, Ru of 5 mass % or more to 20 mass % or less, and Pt of one-twentieth or more to one-half or less of a Ru content.

2. The spark plug according to claim 1, wherein the tip has a Rh content of 7 mass % or more to 27 mass % or less and a Ru content of 5 mass % or more to 17 mass % or less.

3. The spark plug according to claim 1, wherein the tip has a Rh content of 7 mass % or more to 24 mass % or less and a Ru content of 6 mass % or more to 15 mass % or less.

4. The spark plug according to claim 1, wherein the tip has a Rh content of 7 mass % or more to 21 mass % or less, and a Ru content of 6 mass % or more to 13 mass % or less.

5. The spark plug according to claim 1, wherein the tip further contains Ni of 0.1 mass % or more to 4.5 mass % or less.

6. The spark plug according to claim 1, wherein an area S when projecting the tip to an imaginary plane, parallel to a bonding surface of the center electrode or the ground electrode and the tip is 0.07 $mm^2$ or more.

7. The spark plug according to claim 6, wherein the area S is 0.10 $mm^2$ or more.

8. The spark plug according to claim 6, wherein the area S is 0.15 $mm^2$ or more.

* * * * *